US006186466B1

(12) United States Patent
Baird et al.

(10) Patent No.: US 6,186,466 B1
(45) Date of Patent: Feb. 13, 2001

(54) HANGING FRAME STABILIZER

(76) Inventors: Keith Baird, 13624 E. Saginaw Way, Sanger, CA (US) 93657; Bob F. Reinke, 7916 No Fancher, Clovis, CA (US) 93611

( * ) Notice: Under 35 U.S.C. 154(b), the term of this patent shall be extended for 0 days.

(21) Appl. No.: 09/283,113

(22) Filed: Mar. 31, 1999

(51) Int. Cl.[7] ..... A47F 7/14

(52) U.S. Cl. ..... 248/475.1; 248/467; 248/497; 248/547

(58) Field of Search ..... 248/475.1, 476, 248/477, 480, 488, 494, 495, 496, 497, 498, 466, 467, 470, 474, 216.1, 217.3, 217.1; 24/683; 40/152.1, 594

(56) References Cited

U.S. PATENT DOCUMENTS

| | | | | |
|---|---|---|---|---|
| D. 235,308 | * | 6/1975 | Clarke | D8/257 |
| 3,995,821 | * | 12/1976 | Einhorn | 248/497 X |
| 4,040,149 | * | 8/1977 | Einhorn | 248/493 |
| 4,211,382 | * | 7/1980 | Bonfils | 248/467 |
| 5,328,139 | * | 7/1994 | Barnes | 248/475.1 |
| 5,398,906 | * | 3/1995 | Aydelott | 248/547 |
| 5,425,524 | * | 6/1995 | Messina, Jr. | 248/475.1 |
| 5,437,428 | * | 8/1995 | Mirza | 248/467 |
| 5,454,542 | * | 10/1995 | Hart | 248/494 |
| 5,480,120 | * | 1/1996 | Bruner | 248/477 |
| 5,542,641 | * | 8/1996 | Donovan | 248/493 |
| 5,588,629 | * | 12/1996 | Barnes | 248/475.1 |
| 5,605,313 | * | 2/1997 | Erickson et al. | 248/467 |
| 5,878,987 | * | 3/1999 | Hayde | 248/477 |
| 5,992,813 | * | 7/1980 | Keers | 248/489 |

* cited by examiner

*Primary Examiner*—Leslie A. Braun
*Assistant Examiner*—Tan Le
(74) *Attorney, Agent, or Firm*—Mark D. Miller

(57) ABSTRACT

Disclosed is a simple and easy to use device for stabilizing the position of a frame or other object hanging on a wall. The invention includes a small flat panel or medium having a pointed pin or other fastener protruding from one surface. An adhesive is provided on the opposite surface. The invention is designed for use in conjunction with a frame that has already been prepared for hanging on a wall (i.e., a hook, wire, bracket or other hanging means has already been attached to the frame). The device is installed by removing the frame from the wall and placing it face down on a flat surface. The adhesive surface of the invention is then affixed to the back of the frame, preferably near the bottom, such that the pointed pin is protruding up and away from the frame. The frame with device installed is then taken to the wall and hanged. Next, the frame is adjusted and straightened so that it is in the desired position. Once this position is attained, pressure is applied to the front of the frame in the vicinity of the invention causing the pin to be pushed into the wall, thereby holding the frame in place.

9 Claims, 3 Drawing Sheets

HANGING FRAME STABILIZER

BACKGROUND OF THE INVENTION

The present invention relates to wall hanging frames, and more particularly to a new and improved device for stabilizing the position of a picture frame hanging on a wall.

It is common to decorate interior and exterior walls by hanging things on them. Typical room decorations include such things as pictures, photographs, artwork and certificates which are usually mounted in decorative frames. These decorative frames may be hanged from the wall using one of several common devices.

One such device is a wire strung between two screw eyes that are attached to the back of the frame. A screw or nail is partially inserted into the wall, and the wire is placed over the head thereof. The position of the frame may then be adjusted by sliding the wire over the head. Another common frame hanging device is a metal bracket having a sawtooth bottom edge which is attached to the back of the top horizontal member of the frame. An opening or slot on the bottom edge of the bracket is placed over the head of the nail in the wall. Adjustment may be made by sliding along the bottom edge or selecting a different opening or slot in the bracket. In some cases, the frame molding itself or a slot carved therein is simply placed over the head of the nail in the wall.

Regardless of the frame hanging device selected, the position of the frame is invariably subject to movement as a result of such things as cleaning, dusting and the opening and closing of nearby doors. Every time such movement occurs, it becomes necessary to realign and straighten the frame. This can become a time consuming nuisance. It is therefore desirable to provide a device for stabilizing the position of a wall hanging frame.

One such device is a flat one-piece metallic member having a pair of spikes protruding out from one side, and a single spike protruding out from the opposite side. This device has several limitations. First, since it uses spikes it is only usable with wooden frames. It is unsuited for frames made of metal, porcelain, glass or other similar materials. In addition, the spikes are relatively large and are therefore likely to cause damage to the frame or the wall or both.

SUMMARY OF THE INVENTION

The present invention provides a simple and easy to use device for stabilizing the position of any frame hanging on a wall. The invention includes a small flat panel or medium having a thin pointed pin or other fastener protruding from one surface. An adhesive is provided on the opposite surface. The invention is designed for use in conjunction with a frame that has already been prepared for hanging on a wall (i.e., a hook, wire, bracket or other hanging means has already been attached to the frame).

To install the device, the frame is removed from the wall and placed face down on a flat surface. If the frame is new and/or has no hanging means, such a means must be installed on the frame The adhesive surface of the invention is then affixed to the back of the frame, preferably near the bottom, such that the pointed pin is protruding up and away from the frame.

To use the device after it is installed, the frame is first taken to the wall and hanged. Next, the frame is adjusted and straightened so that it is in the desired position. Once this position is attained, pressure is applied to the front of the frame in the vicinity of the invention. This causes the pin to be pushed into the wall, thereby holding the frame in place. For larger frames, a plurality of the stabilizing devices of the present invention may be affixed in order to provide additional stabilization.

The pin may be attached to the upper surface of the panel using any appropriate adhesive, or by applying adhesive tape over the pin to hold it in place, with the pin protruding through the tape. The lower surface of the panel may be provided with an adhesive appropriate for affixation to the material of the frame. One adhesive may be better for use with metal frames, and other adhesives better for use with plastic or wood frames.

Numerous alternative embodiments are available for use with different kinds of frames. In one such embodiment, flat dualsided adhesive material with protective coverings may be employed. A thumbtack or other similar device is inserted between the tape and the adhesive on one side of the material, such that the point of the tack or device protrudes through the tape, the adhesive holding the tack in place. The protective material is removed from the other side of the material in order to attach it to the frame. The frame is then mounted on the wall, adjusted, and pressure applied in the vicinity of the material causing the point to push into the wall thereby securing the frame's position.

In a very simple embodiment, an ordinary thumbtack is provided with an adhesive on the head and a protective covering for the adhesive. The covering is removed in order to allow the head to be adhered to the back of a frame. The frame is then mounted on the wall, adjusted, and pressure applied in the vicinity of the thumbtack to secure the position of the frame on the wall.

In another embodiment of the invention, a tack or other similar device may be slidably mounted on the upper surface of a flat panel between a pair of small flanges such that the head is between the flanges, and the point extends out and away therefrom. The tack is capable of sliding along this track. An adhesive is provided on the opposite surface of the panel, with a protective covering. The covering is removed in order to attach the invention to the back of the frame. The frame is then mounted on the wall. This embodiment is designed to allow for slight slidable movement of the frame on the wall, as when the support wire sags over time, with the tack sliding inside the track.

The present invention is generally designed for use in conjunction with some other frame hanging device. However, for very small frames, one or more of the devices of the present invention may be attached to the back of such small frames and used as the only means of supporting the frame on the wall. In such cases, a single device may be sufficient to support the frame on the wall; however, in order to accomplish the goal of stabilizing the frame on the wall, at least two of the devices must be employed (e.g. one in each upper corner of the frame).

It is therefore a primary object of the present invention to provide a method and apparatus for stabilizing objects and frames hangings on walls.

It is a further important object of the present invention to provide a simple and reliable method and apparatus for holding a frame in place as it hangs on a wall.

It is a further important object of the present invention to provide a method and apparatus for stabilizing the position of a frame or other object which has already been outfitted with a means for hanging it on a wall.

It is a further object of the present invention to provide a method and apparatus for hanging a small frame on a wall.

Other objects of the invention will be apparent from the detailed descriptions and the claims herein. It is to be noted that uses for the present invention extend to any object that hangs on a vertical wall.

DETAILED DESCRIPTION OF THE PREFERRED EMBODIMENTS

Figure 2:
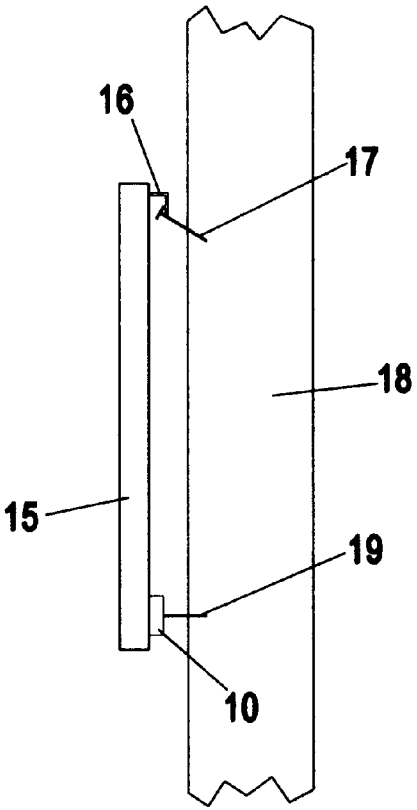
FIG. 2 is a side cutaway view showing the invention installed on a frame hanging from the wall.
Figure 1:
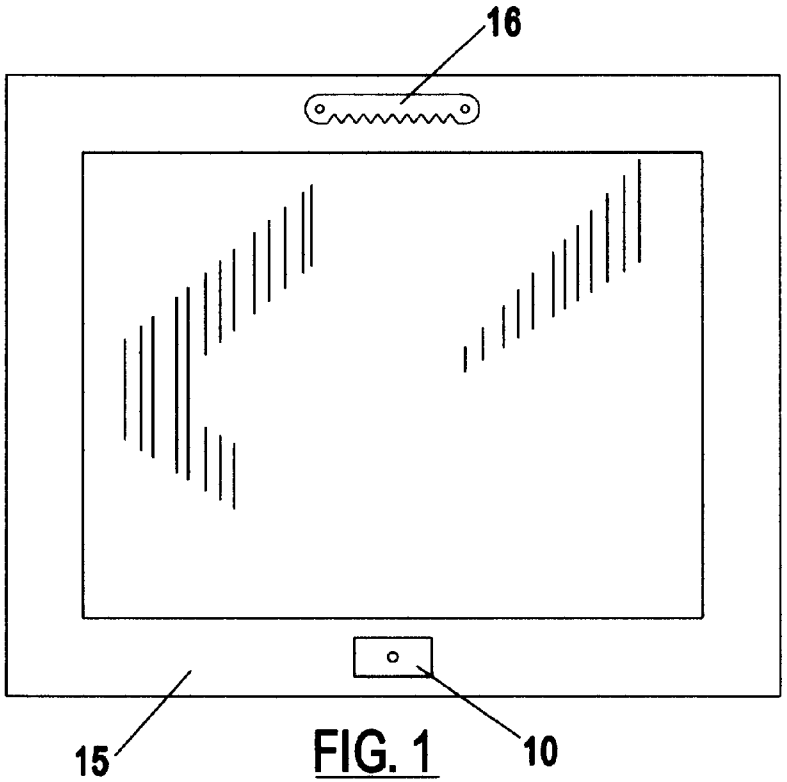
FIG. 1 is a back view of the present invention showing it installed on the back of a wall hanging frame.
Figure 6:
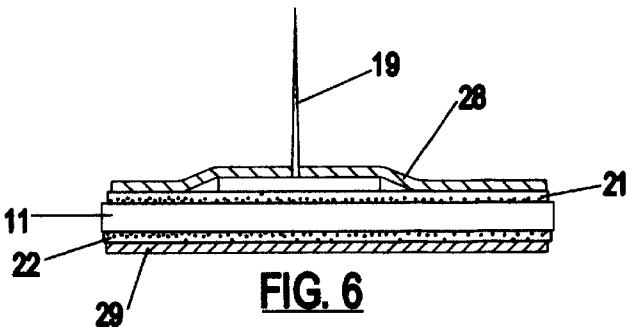
FIG. 6 is a cut away side view of the embodiment of FIG. 5.
Figure 5:
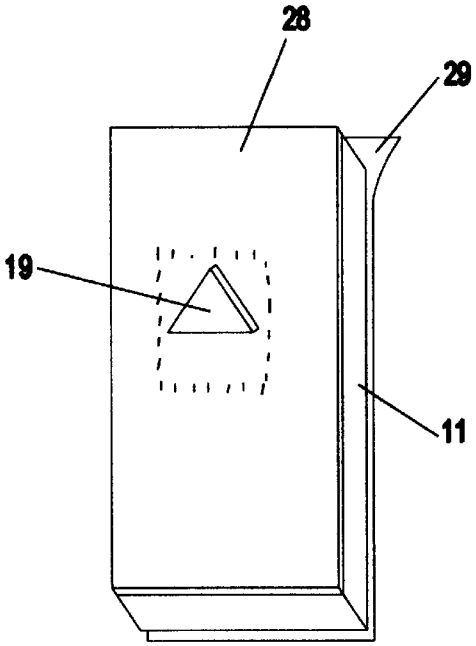
FIG. 5 is perspective view of another embodiment of the present invention.
Figure 4:
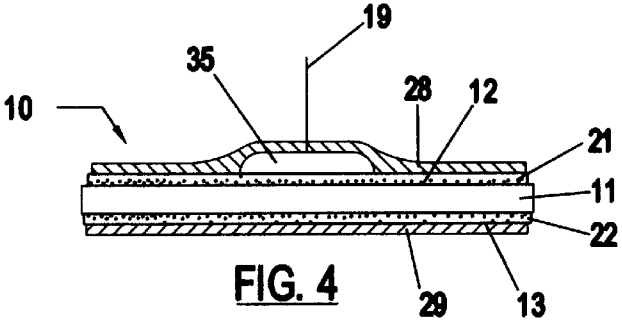
FIG. 4 is a cut away side view of the embodiment of FIG. 3.
Figure 3:
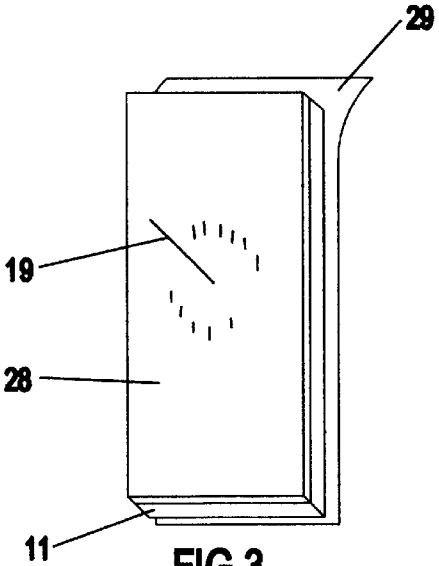
FIG. 3 is perspective view of one embodiment of the resent invention.
Figure 9:
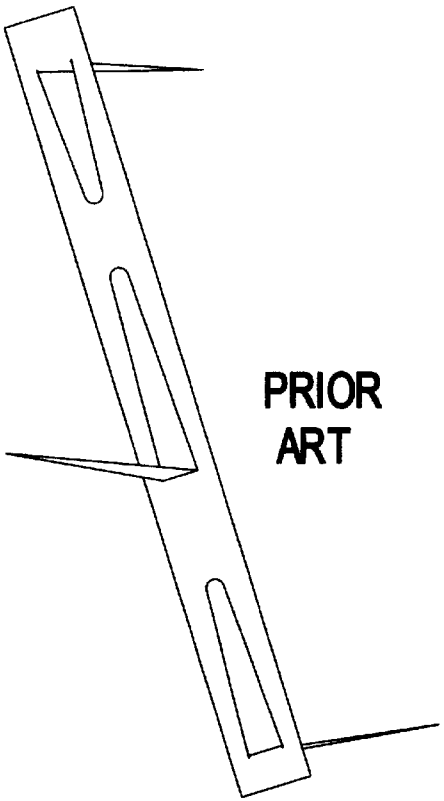
FIG. 9 is a perspective view of the prior art.

Referring to the drawings wherein like reference characters designate like or corresponding parts throughout the several views, and referring particularly to FIGS. 3 and 4 it is seen that the invention includes a flat panel 11 having an upper surface 12 and a lower surface 13. Adhesive material 21 is provided on upper surface 12, and adhesive material 22 is provided on lower surface 13. A removable protective covering 28 is provided over upper adhesive surface 21, and a removable protective covering 29 is provided over lower adhesive surface 22. An pointed member 19 attached to a base 35 is provided on upper surface 12 such that it is attached to adhesive 21 below covering 28. In FIGS. 3, 4, 7 and 8 member 19 is in the form of a pointed pin, thumbtack or nail. In FIGS. 5 and 6, member 19 is in the form of a flat pointed flange attached to base 35. Base 35 is held in place by covering 28, and member 19 protrudes through covering 28. The positioning of base 35 and member 19 may be changed by removing covering 28, adjusting the position of base 35 on adhesive surface 21, and then replacing covering 28, punching member 19 therethrough. Removal of lower covering 29 allows adhesive surface 22 to be attached directly to the back of a wall frame 15 as shown in FIG. 1. The frame 15 may then be hung using conventional means such as a bracket 16 and nail 17 as shown in FIG. 2. Pressure applied to the bottom of the frame causes member 19 to be anchored to the wall 18 holding the frame in a stationary position.

In the alternative embodiment of FIGS. 5 and 6, it is seen that instead of a pointed shaft or pin, member 19 is in the form of a pointed flange. Base 35 is held in place by removable covering 28. Removal of lower covering 29 allows adhesive surface 22 to be attached directly to the back of a wall frame 15.

Figure 7:
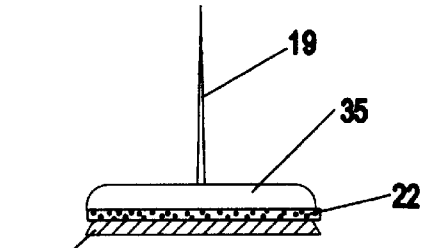
FIG. 7 is cut away side view of yet another embodiment of the present invention.

In the alternative embodiment of FIG. 7, panel member 11 is omitted, and base 35 is provided with adhesive 22 on its lower surface. A removable protective covering 29 is provided under adhesive 22. Removal of lower covering 29 allows adhesive surface 22 to be attached directly to the back of a wall frame 15.

Figure 8:
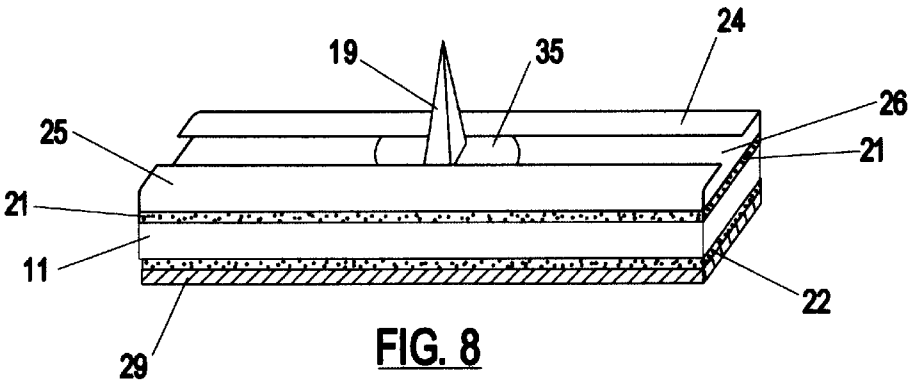
FIG. 8 is a perspective view of yet another embodiment of the invention.

In the alternative embodiment of FIG. 8, it is seen that an upper panel 26 is attached to panel 11 using adhesive 21. Panel 26 includes a pair of longitudinal flanges 24 and 25 that are bent inwardly to form a track. Base 35 is capable of sliding along this track. Member 19 protrudes through the slot defined by the longitudinal space between flanges 24 and 25. Adhesive 22 is provided on the opposite surface of panel 11, with a removable protective covering 29. The covering is removed in order to attach the invention to the back of a frame 15. This embodiment allows for slight slidable movement of the frame on the wall, as base 35 slides along the track.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A device for stabilizing wall hangings comprising a flat panel having a means for attachment to a wall on a first surface thereof, and a means for attachment to a frame on the opposite surface thereof, said means for attachment to the wall comprising a pair of small longitudinal flanges provided on said first surface of said panel forming a track thereon, and a pointed member attached to a base slidably mounted within said track such that the base is between the flanges and the pointed member extends out and away therefrom.

2. The stabilizing device of claim 1 wherein said pointed member is a pin and said frame attachment means is an adhesive.

3. The stabilizing device of claim 2 wherein a removable protective covering is provided over said adhesive.

4. A method for stabilizing an object to be hung from a wall comprising the steps of:

a. attaching at least one stabilizing device to said object in a location that will touch a wall when the object is mounted on the wall, said stabilizing device comprising a flat panel having a pair of small longitudinal flanges provided on a first surface of said panel forming a track thereon, and a pointed member having a base slidably mounted within said track such that the base is between the flanges and the pointed member extends out and away therefrom, and an adhesive means on the opposite surface of said panel;

b. mounting said object on the wall;

c. adjusting said object until it is in a desired position; and d. applying pressure to said object in the vicinity of said at least one stabilizing device in order to engage said at least one stabilizing device with said wall thereby stabilizing the position of said object.

5. The method of claim 4 wherein said pointed member is a pin.

6. The method of claim 5 wherein a removable protective covering is provided over said adhesive.

7. In combination, a wall hanging object and a device for stabilizing it comprising a flat panel having a means for attachment to a wall on a first surface thereof, and a means for attachment to said object on the opposite surface thereof, said wall attachment means comprising a pair of small longitudinal flanges provided on said first surface of said panel forming a track thereon, and a pointed member attached to a base slidably mounted within said track such that the base is between the flanges and the pointed member extends out and away therefrom.

8. The combination of claim 7 wherein said pointed member is a pin and said object attachment means is an adhesive.

9. The combination of claim 8 wherein a removable protective covering is provided over said adhesive.

* * * * *